United States Patent [19]

Stumpp

[11] 4,161,934

[45] Jul. 24, 1979

[54] APPARATUS TO CONTROL THE COMPOSITION OF THE OPERATING MIXTURE OF AN INTERNAL COMBUSTION ENGINE

[75] Inventor: Gerhard Stumpp, Stuttgart, Fed. Rep. of Germany

[73] Assignee: Robert Bosch GmbH, Stuttgart, Fed. Rep. of Germany

[21] Appl. No.: 832,704

[22] Filed: Sep. 12, 1977

[30] Foreign Application Priority Data

Sep. 15, 1976 [DE] Fed. Rep. of Germany ..... 2641398

[51] Int. Cl.[2] ..... F02M 39/00

[52] U.S. Cl. ..... 123/139 AW; 123/139 BG; 123/119 R

[58] Field of Search ..... 123/139 AW, 139 BG, 123/139 BE, 119 R

[56] References Cited

U.S. PATENT DOCUMENTS

| | | | |
|---|---|---|---|
| 3,730,155 | 5/1973 | Knapp | 123/139 AW X |
| 3,983,856 | 10/1976 | Stumpp et al. | 123/139 AW |

*Primary Examiner*—Edgar W. Geoghegan
*Attorney, Agent, or Firm*—Edwin E. Greigg

[57] ABSTRACT

An apparatus to control the composition of the operating mixture of an internal combustion engine in which the fuel is apportioned by means of a variable cross-sectional apportionment area where the pressure drop is kept constant by a differential pressure valve. The uncontrolled pressure chamber (reference pressure chamber) of the differential pressure valve lies downstream of an apportioning recessed area. A given fuel discharge quantity from the controlled pressure chamber of the differential pressure valve is determined in accordance with the fluctuations of the pressure in the reference pressure chamber, and a positioning motor provided for the correction of the magnitude effecting the deviation of the reference pressure is further actuated in accordance with the discharge quantity. The controlled pressure chamber lies upstream of the apportioning recessed area within a fuel supply line connected to a fuel feed pump, and a storage chamber having a wall displaceable against a restoring force as well as a pressure control valve that is connected to the fuel supply line.

13 Claims, 3 Drawing Figures

APPARATUS TO CONTROL THE COMPOSITION OF THE OPERATING MIXTURE OF AN INTERNAL COMBUSTION ENGINE

BACKGROUND OF THE INVENTION

This invention relates to known apparatus in which control of the composition of the operating mixture of an internal combustion engine is provided with a fuel apportioning device, the fuel supply line of which leads from a fuel feed device that supplies fuel at an essentially constant pressure and is arranged to include a throttle valve actuatable by means of an air metering member of the fresh air quantity conducted to the internal combustion engine. Also, in this device the uncontrolled pressure chamber of a differential pressure valve lies downstream of the fuel apportioning device, and a relief line containing a throttle means leads from the controlled pressure chamber lying upstream of the apportioning device, with the relief line being connected to the working chamber of a positioning motor upstream of the throttle.

It is known with such apparatuses that during sizable and fast correction movements of the positioning motor, the essentially constant pressure within the fuel supply line upstream of the apportioning device can no longer be maintained constant, because the output of the fuel feed apparatus is too low and for the reason that under some circumstances an intermittent output then causes additional disadvantages. The fuel pressure which serves in such known apparatuses not only for setting the differential pressure at the cross-sectional apportionment area but also for the creation of a restoring force upon an air metering device displaceable by means of the differential pressure in the intake air flow of the combustion engine must, however, be kept constant to within desired modulating variations in order to maintain the required composition of the operating mixture of an internal combustion engine. A pressure drop occurring during a large adjustment of the positioning motor also further increases the dead period of the control apparatus disadvantageously.

OBJECTS AND SUMMARY OF THE INVENTION

The principal object of this invention is to utilize a fuel pump which may have only a low feed output, the operation of which may either be continuous or intermittent.

Another object of this invention is to provide in the device a storage chamber which will equalize pressure impulses as well as large fuel withdrawals during any necessary adjustments of the positioning motor.

Still another object of this invention is to provide the storage chamber with a displaceable wall that cooperates with a restoring device to form one element of a pressure control valve.

A further object of this invention is to provide a compact unit which enables control of a maximal storage volume.

It is a further particularly advantageous object of this invention that a discharge line extends from the discharge opening to the controlled pressure chamber of a pressure control valve that is controllable in accordance with at least one operational parameter of the internal combustion engine, in which a return check valve that opens in opposition to the discharge direction within the discharge line is provided between the controlled pressure chamber of the pressure control valve and the controlled relief line leading away therefrom. By this means, the discharge line pressure reacting upon the movable wall can advantageously also be kept constant, or else is controlled in accordance with given parameters. By means of this controlled pressure additionally reacting back on the movable wall, the pressure maintained in the fuel supply line upstream of the apportioning device can be selected relative to chosen operational parameters. Further, by means of the parameter dependent controlling of the fuel pressure upstream of the apportioning device, the pressure drop at the barrier plate of the air quantity meter as well as the apportioning area, is varied and consequently so is the relationship of the fuel apportioning quantity to the fresh air quantity. The incorporated return check valve further permits fast equalization movements of the displaceable wall, whenever large fuel quantities are withdrawn for the adjustment of the positioning motor.

These and other objects and advantages of this invention will become apparent from a perusal of the ensuing specification and by reference to the drawings.

DESCRIPTION OF THE PREFERRED EMBODIMENTS

Figure 1:
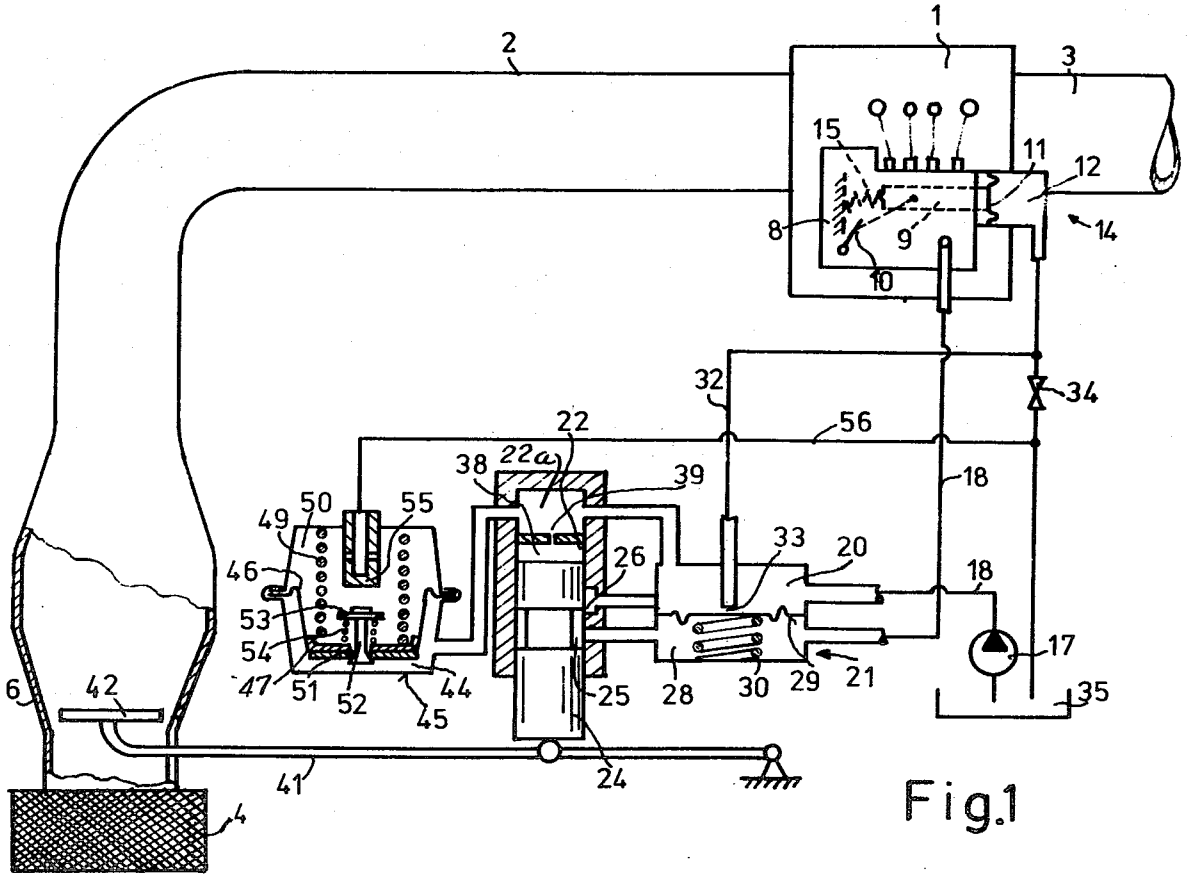
FIG. 1 shows a schematic view of the first embodiment of this invention in which a storage chamber is bounded by a movable diaphragm which includes a push valve.

Turning now to the drawing, FIG. 1 discloses a simplified internal combustion engine 1 with an induction tube 2 and an exhaust gas manifold 3. At its inlet the induction tube 2 is provided with an air filter 4 to which is attached an air funnel 6 that widens out in the direction of air flow toward the internal combustion engine. The combustion engine is supplied with fuel in the normal manner by means of an injection pump indicated schematically at 8. The injection pump can be, for example, a familiar serial injection pump or a distribution type injection pump. The serial injection pump which is shown in the drawing in simplified form includes a quantity adjustment member 9 coupled on one side to an actuating lever 10 and is arbitrarily adjustable therewith; on the other side the adjustment member 9 is connected to a positioning diaphragm 11 that forms one wall of a working chamber 12 of a positioning motor 14. The quantity adjustment member 9 is adjustable for the purpose of reducing the injection fuel quantity by means of a spring 15.

The injection pump 8 is supplied with fuel by means of a fuel supply line 18 through the fuel feed pump 17. The fuel supply line 18 extends through the controlled pressure chamber 20 of a differential pressure valve 21 to a bore 22 provided in a chamber **22*a* and within which a slidable spool valve 24 serves as the throttle member for said fuel supply line 18. The spool valve 24 has an annular groove 25 that communicates with a greater or smaller apportioning area 26 of the fuel supply line 18 at its entrance into the guide bore 22, according to the given position of the spool valve 24**.

The annular groove 25 communicates with a continuation of the fuel supply line 18 that leads via the uncontrolled pressure chamber 28 of the differential pressure valve 21 and thence to the injection pump 8. The uncontrolled pressure chamber 28 of the differential pressure valve 21 is separated from the controlled pressure chamber 20 by means of a diaphragm 29 that is biased by a pressure spring 30 disposed in the uncontrolled pressure chamber 28. A relief line 32 protrudes into the controlled pressure chamber 20 and is provided with an aperture 33 that cooperates with the diaphragm 29 to form a valve. The relief line 32 communicates with the working chamber 12, as shown and the fuel storage container 35 via an adjustable throttle 34. The upper surface of the spool valve 24 together with the inner wall of chamber 22*a* forms a pressure chamber 38 within the guide bore 22 which is connected via a damping throttle 39 with the fuel supply line 18 upstream of the apportioning area 26 that is provided in chamber 22*a*. The opposite end of the spool valve 24 is pressed by means of the fuel pressure against a swing arm 41 that is pivotably supported at one end, as shown, with its other free end being attached to a barrier plate 42 oriented transversely relative to the direction of flow of the air aspirated via the induction tube and oscillatable within the air funnel 6.

A storage chamber 44 is provided with a diaphragm and the surface therebeneath communicates with the pressure chamber 38 whose one wall is displaceable. The diaphragm 46 is hermetically constrained within a pressure capsule 45, and is biased via a spring dish 47 in the direction shown in FIG. 1 by means of a soft pressure spring 49. The opposite side of diaphragm 46 supports the pressure spring 49 in a chamber 50 which is embodied as the fuel collection chamber. The center of the spring dish 47 is provided with a discharge opening 51 within which is arranged a valve closure member 52. This valve closure member includes a conical closure part which protrudes into the storage chamber 44 and is provided at is opposite extremity within the fuel collection chamber 50 with a stop portion that receives an annulus, and a pressure spring 54 is captively constrained between the spring dishes 53 and 47. The fuel collection chamber 50 is arranged to receive a tubular perforated element 55 that is disposed coaxial with the valve closure member 52 with the element 55 being connected to a discharge line 56 that leads to the fuel storage container 35.

OPERATION OF EMBODIMENT I

The above described apparatus that forms the first embodiment of this invention functions as follows:

The internal combustion engine 1 is supplied with fuel in the usual manner by means of the injection pump 8. The given position of the quantity adjustment member 9, arbitrarily adjustable by means of the actuating lever 10 therein, essentially determines the given introduced fuel quantity. Corresponding to the rpm herein established, according to the given load, the air required for the burning of the fuel, particularly for self-igniting internal combustion engines, is aspirated via the induction tube 2. The injection pump 8 is supplied with fuel via the fuel supply line 18 and the delivered fuel quantity per unit of time is determined by means of the given size of the cross-sectional area 26 and by the pressure differential there prevailing. This pressure differential is maintained by means of the pressure valve 21 and the subsequent positioning motor 14, and is based on an essentially constant fuel pressure in the fuel supply line 18. The fuel from the storage container 35 is introduced under pressure via the feed pump 17 into the supply line 18 which is in direct communication with the storage chamber 44. During a pressure rise the diaphragm 46 is deflected in opposition to the force of the spring 49 until the valve closure member 52 touches the element 55. During a further deflection of the diaphragm 46, the valve closure member 53 is pushed open in opposition to the force of the spring 54, so that fuel reaches the fuel collection chamber 50 via the discharge opening 51, and from there again reaches the fuel storage container 35 via the discharge line 56. In this manner a constant pressure, as determined by the restoring force of the soft spring 49, is maintained in the fuel supply line 18 upstream of the apportioning recess area 26. The storage chamber 44 then assumes its largest volume.

Thus, the regulated fuel pressure now acts as the reference pressure both in the controlled pressure chamber 20 upon the diaphragm 29 as well as upon the spool valve 24. Pressure, diminished by the pressure drop at the apportioning recess area 26, prevails in the uncontrolled pressure chamber 28. This diminished pressure, together with the pressure spring 30, opposes the pressure in the controlled pressure chamber 20, so that in the stable state a force equilibrium is established at the diaphragm 29. The pressure drop at the apportioning recessed area 26, i.e. the prevailing differential pressure, is determined by the pre-tension and by the intrinsic characteristics of the pressure spring 30 in conjunction with the pressure maintained in the controlled pressure chamber 20.

In the stable state, moreover, a force equilibrium exists at the spool valve 24. The pressure acting via the damping throttle 39 on the spool valve 24 within the pressure chamber 38 is maintained by means of the force transmitted by the swing arm 41. This force is a consequence of the pressure differential which acts on the barrier plate 42 due to the introduction of intake air. Because of the constant restoring force transmitted via the spool valve 24 onto the swing arm 41, the pressure drop at the barrier plate 42 also remains constant. During an increasing air throughput and a consequently increasing pressure differential, the barrier plate 42 is deflected in the direction of the flow until the original pressure differential is again established by the enlargement of the annular space between the barrier plate 42 and the air funnel 6. The spool valve 24 is thereby also displaced and, in this case, the cross-sectional apportioning area is enlarged. By reason of the shape of the air funnel 6 and the entrance opening of the fuel supply line 18 into the annular groove 25, the pressure differential at the apportioning cross section is held constant, a definite given relationship between the aspirated air and the apportioned fuel quantity is obtainable in the known manner over the entire range of the combustion engine.

If the rpm of the internal combustion engine, proceeding from a stable state, decreases slightly due to an increasing load or due to an adjustment of the quantity adjustment member 9 in the direction of a lesser quantity, then the barrier plate 42 is displaced in opposition to the direction of flow. The spool valve 24 is simultaneously displaced as well, so that the cross-sectional apportioning recessed area 26 decreases. Due to this throttling action, a pressure drop next results in the uncontrolled pressure chamber 28. The diaphragm 29 thereby frees the aperture 33 of the relief line 32 to a greater extent, so that a greater amount of fuel is discharged and an increased pressure is established in the working chamber 12 of the positioning motor with the aid of the throttle 34. This increased pressure now causes the quantity adjustment member 9 to be displaced in the direction toward a lessening of fuel flow. Due to the now lessened fuel quantity flowing to the injection pump 8 via the fuel supply line 18, the pressure in the uncontrolled pressure chamber 28 can now build up to the original magnitude which corresponds to the equilibrium state. Although a definite injection quantity is pre-selected by means of this apparatus through the adjustment of the actuating lever 10, or of the quantity adjustment member 9, an additional corrective adjustment of the quantity adjustment member takes place via the differential pressure valve 21, so that finally only that injection quantity determined by the differential pressure and by the size of the apportioning recessed area 26 reaches the internal combustion engine. Hence a definite relationship between fuel and air can be maintained in all of the operational regions of the internal combustion engine.

If a fast and, for example, an also large correction must be performed by the positioning motor 14, then in addition to the supplied fuel quantity that reaches the injection pump, a supplemental fuel quantity must be made available without, however, thereby dropping the controlled pressure in the fuel line 18 upstream of the apportioning area 26. This requirement would normally necessitate a high feed output of the fuel feed pump 17. But in the present novel apparatus a sufficient fuel quantity is stored at this constant system pressure in the storage chamber 44 and can flow toward the working chamber 12 after the aperture 33 of the relief line 32 is opened, thereby allowing the soft pressure spring 49 to expand. Due to the characteristics of this spring, the system pressure upstream of the apportioning recessed area also remains constant in this case. The volume of the storage chamber 44 is compatible to the maximal volume variation of the positioning motor 14. After the positioning process has been completed, the storage chamber is again filled by the fuel feed pump 17. The pump can be driven to produce an essentially low output, and a system pressure, the constant value of which is of crucial significance for the exact control of the air to fuel relationship, can nevertheless be accurately maintained therein.

The apparatus described above, especially with the incorporation of the positioning motor at the injection pump, is merely one typical embodiment of this invention. The positioning motor also can be deployed in a known manner at other locations for the desired adjustment. For example, a throttle valve in the induction tube 2, which simultaneously controls the cross-sectional area of an exhaust gas recycling line, can be actuated by means of a like positioning motor. On the other hand, a like positioning motor can be employed for the subsequent throttling of the fuel supply line 18 downstream of the apportioning recessed area 26. In addition, it is to be understood that the construction of the storage chamber is not considered to be restricted to the embodiment illustrated and described. Instead of a diaphragm having a displaceable wall which serves to bound the storage chamber, a piston also acted upon on its rear face by a constant hydraulic pressure or gas pressure can, for example, also be used. In lieu of the push valve shown, a pull valve also can be employed in an equivalent embodiment.

Figure 3:
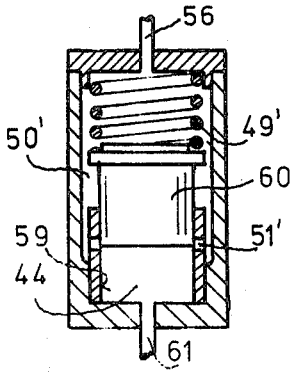
FIG. 3 shows still another embodiment of this invention in which a spool valve is used for control purposes.

FIG. 3 depicts a further embodiment in which the storage chamber 44 is enclosed by a piston 60 that is guided in a close fitting blind bore 59 with its lower surface subjected to fuel pressure at 61. At its upper surface the piston 60 is acted on by a soft pressure spring 49' that is braced against the inner face of the wall of a fuel collection chamber 50'. One or several discharge openings 51' lead radially from the blind bore 59 provided in the sleeve, thence to the fuel collection chamber 50'. The location of the discharge openings 51' therein determines the point of the maximal displacement of the piston 60, and therewith the maximal volume of the storage chamber 44. The storage chamber is connected via a line 61 with the fuel supply line 18 upstream of the apportioning recessed area 26 as in the embodiment according to FIG. 1. From the fuel collection chamber there is also provided a discharge line 56, all of which is readily understood by reference to FIG. 1. The embodiment according to FIG. 3 also incorporates both a storage chamber as well as a pressure control valve. The desired system pressure is determined by the stiffness of the spring 49', wherein due to the large available excursion of the spring a desired constant system pressure can nevertheless be maintained over a long piston travel.

Instead of the embodiments discussed above, a piston or a diaphragm serving as the movable wall of the storage chamber 44 also can be connected to a spool valve, which controls the metering area of a discharge line exiting from the storage chamber 44, with the aid of an annular groove.

Figure 2:
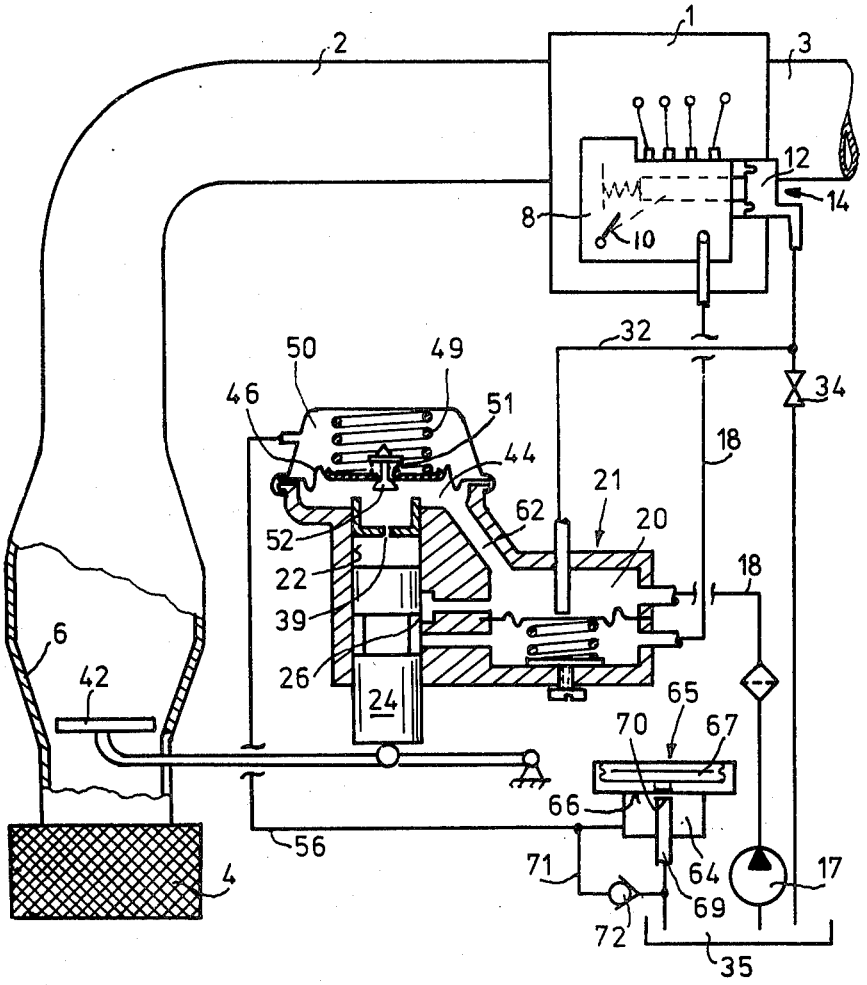
FIG. 2 shows a further embodiment of this invention which includes a correction effecting pressure control valve positioned in a discharge line of the storage chamber.

The exemplary embodiment according to FIG. 2 illustrates an advantageous refinement of the embodiment of the invention according to FIG. 1. The construction of this exemplary embodiment is essentially the same as that of FIG. 1, so like parts will have applied thereto the same similar reference characters, and their description and function will be derived from the corresponding text relating to FIG. 1.

Turning now to the description of FIG. 2, the storage chamber 44 is arranged coaxially with the guide bore 22 and the two merge together via the interposed damping throttle 39. The storage chamber 44 is connected via a line 62 directly to the controlled pressure chamber 20 of the differential pressure valve 21 and generally simulates the exemplary embodiment according to FIG. 1. The valve closure member 52 shown in this view is constructed as a push valve which controls the discharge opening 51 provided in the diaphragm 46 bounding the storage chamber 44. As distinguished from the exemplary embodiment according to FIG. 1, the discharge line 56 leads from the fuel collection chamber 50 into the controlled pressure chamber 64 of a corrective pressure control valve 65. The controlled pressure chamber 64 shown here is bounded by a diaphragm 66 acted upon at its opposite side by means of a barometer capsule 67. A relief line 69, which includes an aperture 70 protrudes into the controlled pressure chamber 64 and together with the diaphragm 66 form a valve. A connecting line 71 which contains a return check valve 72 that opens in opposition to the discharge direction of the fuel in the relief line is provided between the relief line that leads to the fuel storage container 35 and the controlled pressure chamber 64.

OPERATION OF EMBODIMENT II

The above described apparatus that forms the second embodiment of this invention functions as follows: When the internal combustion engine provided with this concept is in a stable operational state at which time no positioning maneuvers need to be performed by the positioning motor, then the storage chamber is in its fully filled condition and a constant controlled fuel quantity is being discharged via the discharge opening 51, so long as the injection fuel quantity also remains constant. This discharge quantity does not flow directly back to the fuel storage container 35, but rather must first traverse the corrective pressure control valve 65 so that a constant pressure determined by the corrective pressure control valve 65 establishes itself in the return flow line 56 and also in the remaining volume of the fuel collection chamber 50. The system pressure upstream of the apportioning recessed area 26 can be influenced with the aid of the corrective pressure control valve 65. In particular, the surrounding ambient pressure can thereby be taken into account by means of the barometer capsule 67. However, it is also possible to influence the pre-tension of a pressure control spring relative to the load, for example, in accordance with the position of the adjustment lever 10. It is also possible to achieve a correction of the system pressure upstream of the recessed apportioning area by means of a familiar electromagnetic influence upon the control force which acts on the diaphragm 46, which corresponds to chosen operational parameters.

If, in the case of a large adjustment of the positioning motor, the storage volume of the storage chamber 44 is needed, then a fast displacement of the diaphragm 46 is possible by means of the non-return valve 72, which bypasses the pressure control valve 65.

It is to be understood that the variations and various application possibilities named earlier in the explanation of FIG. 1 and FIG. 3 are also employable for the structure of FIG. 2.

What is claimed is:

1. In a control apparatus for controlling the composition of the operating mixture of an internal combustion engine, and including: air metering means for metering the air quantity aspirated into the engine; fuel supply means; a fuel apportioning device including throttle means connected to and actuatable by the air metering means; a fuel supply line leading from the fuel supply means to the fuel apportioning device, said fuel supply means supplying fuel through the fuel supply line to the fuel apportioning device at an essentially constant pressure; a differential pressure control valve connected to the fuel supply line between the fuel supply means and the fuel apportioning device, said differential pressure control valve having a controlled pressure chamber situated upstream of said throttle means and an uncontrolled pressure chamber situated downstream of said throttle means; a fuel injection pump; positioning means for adjustment of the air fuel ratio of the operating mixture said positioning means having a working chamber; and a relief line containing throttle means, said relief line being connected to the controlled pressure chamber and to the working chamber upstream of its throttle means, the improvement comprising:

(a) means defining a storage chamber having a displaceable wall, said fuel supply line being connected upstream of the throttle means of the fuel apportioning means to the storage chamber;

(b) force applying means being connected to said displaceable wall, said displaceable wall being displaceable in opposition to an essentially constant force produced by the force applying means to a terminal position; and (c) a pressure control valve connected to the fuel supply line upstream of the throttle means of the fuel apportioning means.

2. The control apparatus as defined in claim 1, wherein the displaceable wall and the force applying means comprise part of the pressure control valve, said displaceable wall having a discharge opening associated therewith, and said pressure control valve having a valve closure member disposed to control the discharge opening.

3. The control apparatus as defined in claim 2, wherein the valve closure member is constructed as a control slider.

4. The control apparatus as defined in claim 3, wherein the storage chamber is formed into a blind bore by its defining means, wherein the control slider is a piston guided within and forming a close fit with the blind bore, the face surface of the piston comprising the displaceable wall, wherein the discharge opening is formed in the storage chamber defining means and leads radially out of the blind bore, said discharge opening being controlled by means of the cylindrical surface of the piston, and wherein the terminal position of the piston within the blind bore is determinable by means of the location of the discharge opening.

5. The control apparatus as defined in claim 3, further comprising:

(d) a discharge line, wherein the storage chamber is connected to the discharge line, and wherein the control slider is located in the discharge line.

6. The control apparatus as defined in claim 2, wherein the pressure control valve further includes a projection which determines the terminal position of the displaceable wall, and a closure spring which links the valve closure member to the displaceable wall, wherein the discharge opening is formed in the displaceable wall, and wherein the closure member is actuatable in opposition to the force of the closure spring by means of the projection.

7. The control apparatus as defined in claim 1, wherein the pressure control valve further includes a fuel collection chamber separated from the storage chamber by the displaceable wall, and a pressure spring located in the fuel collection chamber, said pressure spring acting as the force applying means upon the displaceable wall, and wherein the storage chamber and the fuel collection chamber are connected by the discharge opening.

8. The control apparatus as defined in claim 2, further comprising:

(d) a discharge line;

(e) a corrective pressure control valve being a controlled pressure chamber connected to the discharge opening by the discharge line, and a controlled relief line leading from the controlled pressure chamber, said controlled pressure chamber being controllable in accordance with at least one operational parameter of the engine; and (f) a return check valve connected to the discharge line and the controlled relief line, and opening in opposition to the discharge direction in the discharge line.

9. The control apparatus as defined in claim 8, wherein the corrective pressure control valve further includes a barometer capsule for gauging the surrounding ambient pressure, said barometer capsule serving as the control magnitude for the corrective pressure control valve.

10. The control apparatus as defined in claim 8, further comprising:

(g) a control spring the tension of which is variable in accordance with the adjustment of a load setting lever, wherein the tension of the control spring serves as the control magnitude for the corrective pressure control valve.

11. The control apparatus as defined in claim 1, further comprising:

(d) an induction tube having a funnel-shaped section which widens in the direction of air flow, wherein the air metering means comprises: a pivotably mounted arm; and a barrier plate attached to the pivotably mounted arm and disposed for pivotable displacement with the funnel-shaped section of the induction tube, wherein the fuel apportioning means includes means defining a guide bore and a control slider which defines part of the throttle means, said control slider being displaceable within the guide bore and being engageable with the pivotably mounted arm serving thereby as a restoring means for the pivotably mounted arm, and wherein the control slider is exposed to the essentially constant pressure of the fuel within the fuel supply line upstream of the throttle means.

12. The control apparatus as defined in claim 11, wherein the guide bore merges at its end remote from the pivotably mounted arm into the coaxially adjoining storage chamber.

13. The control apparatus as defined in claim 1, wherein the maximal volume of the storage chamber is at least as large as the maximal adjustment volume of the working chamber of the positioning means.

* * * * *